US006805045B1

(12) United States Patent
Körner et al.

(10) Patent No.: US 6,805,045 B1
(45) Date of Patent: Oct. 19, 2004

(54) PRESS PRODUCTION SERIES WITH OFFSET DRIVE

(75) Inventors: Ekkehard Körner, Göppingen (DE); Rainer Güthle, Ebersbach/Weiler (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 74 days.

(21) Appl. No.: 09/629,186

(22) Filed: Jul. 31, 2000

(30) Foreign Application Priority Data

Jul. 29, 1999 (DE) ..... 199 35 655

(51) Int. Cl.[7] ..... B30B 1/06; B30B 15/20
(52) U.S. Cl. ..... 100/193; 100/273; 100/282
(58) Field of Search ..... 100/249, 272, 100/286, 273, 193, 208, 282, 281, 283; 475/248, 14, 5; 72/449, 273

(56) References Cited

U.S. PATENT DOCUMENTS 3,269,219 A * 8/1966 Hart ..... 74/781
3,557,686 A * 1/1971 Sapolsky ..... 100/208
4,034,666 A * 7/1977 Bigun et al. ..... 100/231
4,434,646 A * 3/1984 Maeda et al. ..... 100/231
5,012,665 A * 5/1991 Brandstetter ..... 72/405
5,468,194 A * 11/1995 Hayashi ..... 100/53
5,915,296 A * 6/1999 Itakura ..... 100/209
6,021,683 A * 2/2000 Doege et al. ..... 100/282
6,305,279 B1 * 10/2001 Telkamp et al. ..... 100/193
6,453,806 B1 * 9/2002 Bornhorst et al. ..... 100/282

FOREIGN PATENT DOCUMENTS

JP 06126496 A * 5/1994
JP 06142996 A * 5/1994

* cited by examiner

*Primary Examiner*—Allen Ostrager
*Assistant Examiner*—Jimmy Nguyen
(74) *Attorney, Agent, or Firm*—Fitch, Even, Tabin & Flannery; Norman N. Kunitz; George H. Spencer

(57) ABSTRACT

In a press production series for massive forming with a toggle drive for driving a ram, varying stroke speeds of the ram motion are attached by adjustment of cogwheels of an planetary gear system having fixed connecting dimensions. Uniform machine frames can thus be used.

5 Claims, 3 Drawing Sheets

PRESS PRODUCTION SERIES WITH OFFSET DRIVE

CROSS-REFERENCE TO RELATED APPLICATIONS

The application is related to two other applications entitled (1) Press with Ejector Device for Different Ejector Strokes, whose inventors are Ekkehard Körner and Martin D öringer, Ser. No. 09/629,185, and (2) Press Product line, whose inventors are Ekkehard Körner and Martin Döringer, Ser. No. 09/629,185.

BACKGROUND OF THE INVENTION

This application claims the priority of 199 35 655.6, filed on Jul. 29, 1999, the disclosure of which is expressly incorporated by reference herein.

The present invention concerns a press which is a member of a press production series and has production series, particularly for massive forming, with a machine frame, with a ram which is guided journalled and disposed for attachment of a first tool component, with a ram drive which is positioned on the machine frame and presets a path-time trace of the ram and which comprises at least one electric motor and at least one eccentric shaft connected to one another via a drive means, and with a table which is positioned opposite to the ram on the machine body and is disposed for attachment of a second tool component.

Mechanical presses having varying stroke speeds corresponding to the task for which they are used are often utilized, particularly for massive forming. In addition, depending on the operating conditions, varying path-time curves of the ram motion may be desired.

A toggle drive or another type of lever drive connecting a continuously rotating eccentric with the ram is often used in this type of press as a mechanical ram drive. The eccentric shaft is connected with the drive motor via a step-down gear with so that the speeds match. Various path-time traces and stroke speeds can be attained with different drive configurations. This represents a significant expense in manufacturing technology.

A mechanical press with a crank-toggle drive is known from DE 2127289 which has two eccentrics positioned at fixed offset angles to one another and two separate connecting rods. The eccentric shaft is connected with a cogwheel which meshes with the pinion of a drive motor. The press does not provide, however, for changing gear ratios.

SUMMARY OF THE INVENTION

An object of the present invention is to reduce the expenditure for the production of presses with varying stroke speeds.

According to the invention, various presses are combined into a press production series, within which the presses only vary in regard to the configuration of their ram drives. These include a step-down gear and a gear to transform rotational motion into linear motion. The ram drives are preferably driven from drives which are uniform within the press production series, e.g., in the form of uniform clutch-brake combinations. This is made possible by providing that all presses in the series do not exceed a given maximum eccentric torque. This becomes possible when the gradient of the path-time traces of the ram motion when approaching bottom dead center does not exceed a given limiting value. This limiting value is preferably uniformly determined for all presses of a series.

Matching of different stroke speeds is possible through varying gear systems which have uniform connecting dimensions within the press production series. They are preferably realized as planetary gears with uniform connecting dimensions. The planetary gears can be driven by the electric motor via a belt drive or another type of drive which is uniform within the press production series. The uniform connecting dimensions allow the use of uniform press bodies, press heads and similar items.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
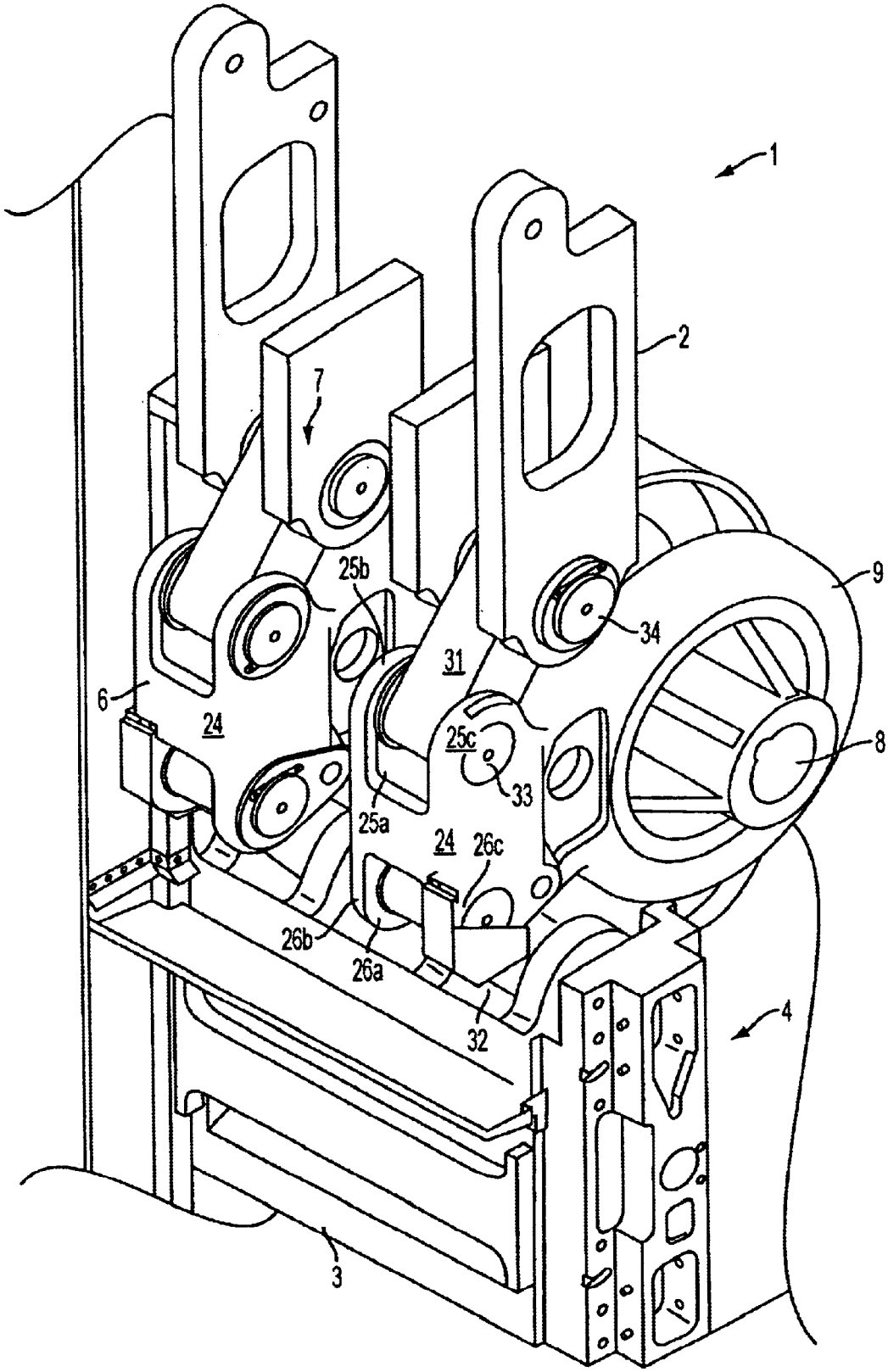
FIG. 1 is a perspective detail view of a toggle press in accordance with the present invention.

FIG. 1 illustrates a modified toggle press 1 which is used, for example, for massive forming. A ram 3 is journalled vertically movable in a machine frame 2. A ram guide 4, realized as a linear guide, serves to guide in the machine frame 2. A table is arranged below the ram 3 which is journalled on the machine frame 2 or realized from same, and the table accepts a lower tool. The ram 3 is disposed to accept an upper tool, all in a generally known manner.

Figure 2:
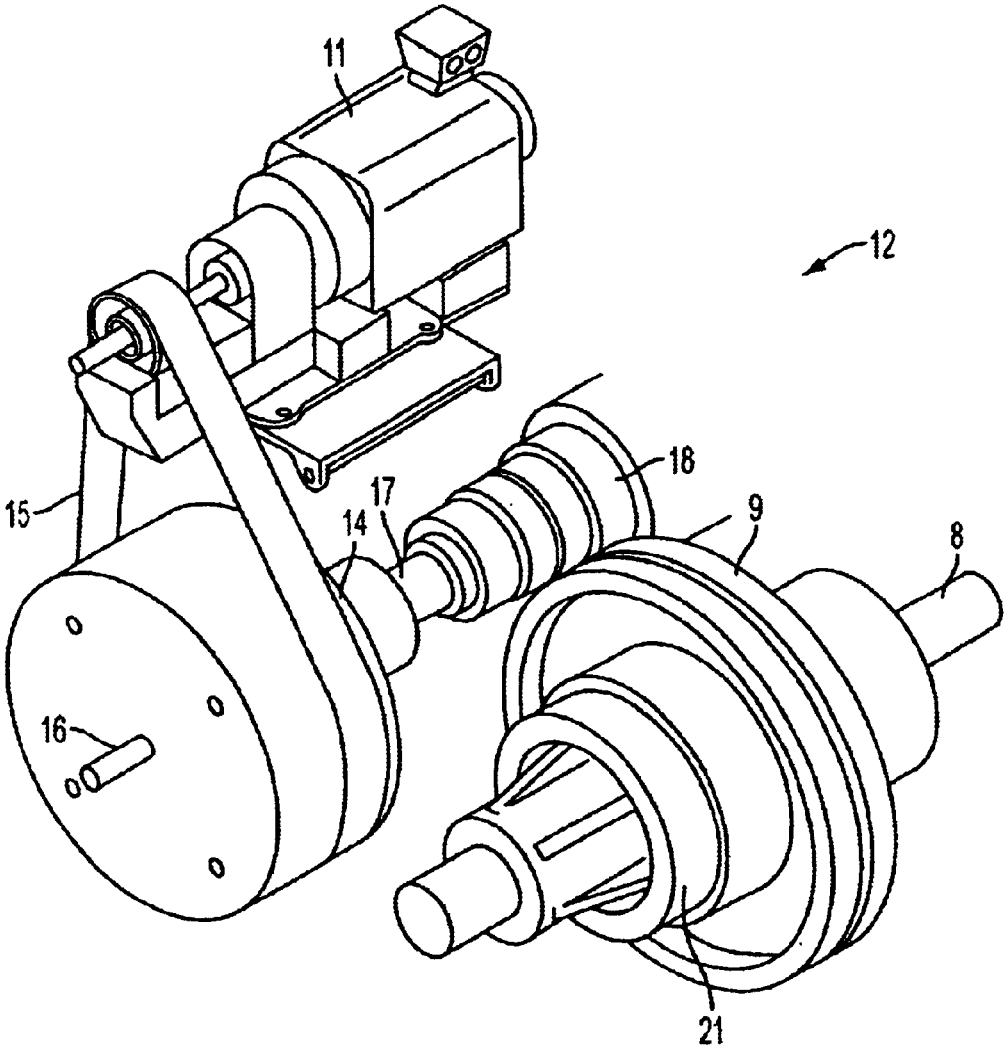
FIG. 2 is a perspective detail view of a drive of a toggle press as shown in FIG. 1.

A ram drive 6 which includes a modified toggle drive 7 driven by an eccentric shaft 8 serves to drive the ram 3. The shaft 8 is driven via a driving agent, e.g., a cogwheel 9, by an electric motor 11 (see FIG. 2). A flange-mounted offset drive 12, preferably in the form of a planetary gear system, can be positioned between the electric motor 11 and the cogwheel 9 next to the flywheel. Its ring gear 14 is, for example, driven by the electric motor 11 via a belt 15. Its sun gear is supported via a shaft 16, preferably so that it rotates with the shaft, while its planet carrier drives a pinion 18 meshing with the cogwheel 9 via a driven shaft 17. By using equal external dimensions, particularly equal ring gears 14 and other connecting dimensions, the desired varying transmission ratios for different stroke speeds can be attained by replacing the sun gear and planet gears.

An eccentric 21 is seated on the rotatable journalled eccentric shaft 8 so that it rotates with the shaft. A connecting rod 22 with a corresponding connecting rod bearing 23 is run on bearings on the eccentric 8. The connecting rod 22 has a head 24 on the end lying away from the eccentric 21 on which two bearings 25, 26 are realized positioned separated from one another. The bearings 25, 26 define a triangle with the center of the connecting rod bearing 23.

The bearings 25, 26 are formed by bores in the corresponding attachment regions 25*a*, 26*a* of the connecting rod 22. The connecting regions 25*a*, 26*a* are, as can be seen in FIG. 1, predetermined recesses between two plate shaped walls 25*b*, 25*c*; 26*b*, 26*c* which are dimensioned relatively large in order to be able to provide bores for bearings within a relatively large region.

The connecting rod 22 is connected with the machine body 2 and the ram 3 via links 31, 32. The link 31 extends into the upper opening formed between the walls 25*b*, 25*c* of the connecting rod, and is rotatably journalled here by a pivot pin 33. It is journalled with the machine frame 2 with a pivot pin 34 on its opposite upper end.

Figure 3:
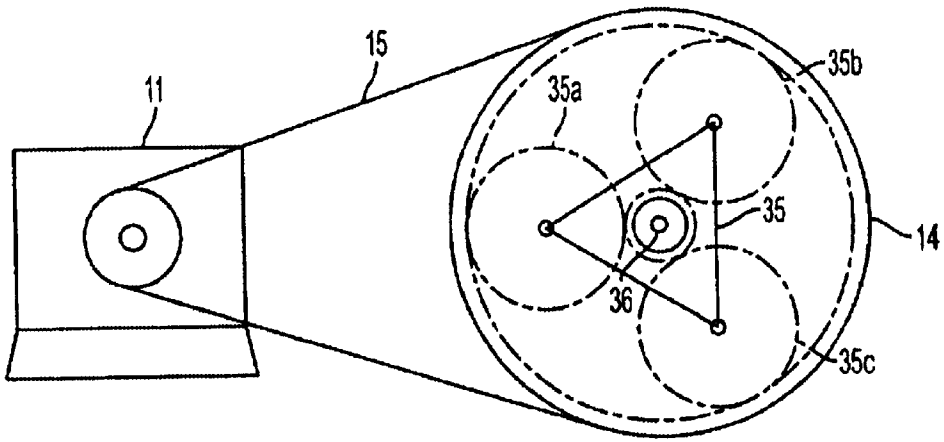
FIG. 3 is a schematic view of a drive and a gear system for a press of a press production series.
Figure 4:
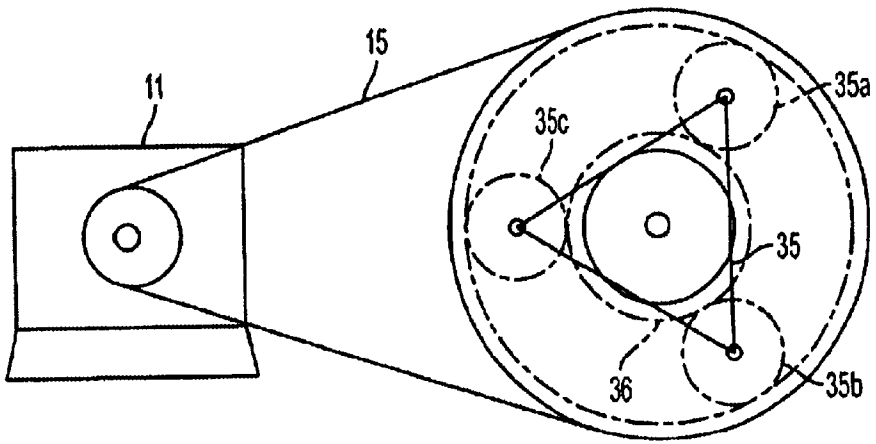
FIG. 4 is a schematic view of a drive and a gear system of another press of the same press production series.

The first press embodiment with the gear system according to FIG. 3 has a lower stroke speed and a greater nominal force than the second press embodiment with the gear system according to FIG. 4. The gear systems only differentiate themselves in regard to the planet gears 35*a*, 35*b*, 35*c*, the planet bearer 35, and the sun gear 36. All of the assembly points and external dimensions of the predetermined elements of the gear system, such as, for example, the toothed belt 15, the electric motor 11, and the ring gear 14, as well as the rotational axes of the sun gear 16 and the output of the electric motor 11, correspond to each other in both embodiments. Therefore, the stroke speed within the press production series can be adjusted to concrete requirements merely by modification of the planet gears 35*a*, 35*b*, 35*c* (and the planet bearer 35), as well as the sun gear 36.

For a press production series 1 for massive forming with toggle drives 7 to drive the ram 3, varying stroke speeds of the ram movement are attained by adjustment of cogwheels of a planetary gear system whose connecting dimensions are unchangeably fixed. In this respect, uniform machine frames 2 can therefore be used.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A production series of presses for massive forming, wherein each of the presses of the series comprises:

a machine frame;

a ram guided in a journalled manner on the frame and arranged for attachment of a first tool component;

a ram drive mounted on the machine frame and providing a path-time trace of the ram to attain a predetermined stroke speed, with the ram drive comprising at least one electric motor and at least one eccentric shaft connected to one another via an offset drive unit, and a table positioned opposite to the ram on the machine frame and arranged for attachment of a second tool component; and, wherein the presses of the production series each have substantially the same respective machine frame and a respective drive unit, with the respective drive units all having the same outer dimensions and external connections but producing respectively different path-time traces and speeds for the respective rams of the presses of the production series.

2. The production series of presses according to claim 1, wherein the offset drive unit comprises a planetary gear system.

3. The production series of presses according to claim 2, wherein the drive unit includes a belt drive positioned between the planetary gear system and the electric motor.

4. The production series of presses according to claim 1, wherein an eccentric torque of each respective press of the press production series does not exceed a given common eccentric torque.

5. The production series of presses according to claim 4, wherein the gratient of the path-time of the ram motion of each respective press of the press production series does not exceed a given common limit value when approaching bottom dead center.

* * * * *